US007965249B1

(12) United States Patent
Wolf et al.

(10) Patent No.: US 7,965,249 B1
(45) Date of Patent: Jun. 21, 2011

(54) RECONFIGURABLE RADIO FREQUENCY (RF) SURFACE WITH OPTICAL BIAS FOR RF ANTENNA AND RF CIRCUIT APPLICATIONS

(75) Inventors: Jeremiah D. Wolf, Cedar Rapids, IA (US); Nathan P. Lower, North Liberty, IA (US); Lee M. Paulsen, Cedar Rapids, IA (US); Jonathan P. Doane, Cedar Rapids, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 448 days.

(21) Appl. No.: 12/150,139

(22) Filed: Apr. 25, 2008

(51) Int. Cl.
*H01Q 9/00* (2006.01)

(52) U.S. Cl. ..... 343/745; 343/700 MS; 343/749; 343/755; 343/778

(58) Field of Classification Search ..... 343/700 MS, 343/755, 853, 909, 745, 749, 778, 815, 876
See application file for complete search history.

(56) References Cited

U.S. PATENT DOCUMENTS 6,417,807 B1 * 7/2002 Hsu et al. ..... 343/700 MS
6,859,189 B1 * 2/2005 Ramirez et al. ..... 343/815
7,013,061 B2 * 3/2006 Lee et al. ..... 385/21
7,057,704 B2 * 6/2006 Seul et al. ..... 355/53
7,068,234 B2 * 6/2006 Sievenpiper ..... 343/745
7,071,888 B2 * 7/2006 Sievenpiper ..... 343/745
7,151,506 B2 * 12/2006 Knowles et al. ..... 343/909
7,245,269 B2 * 7/2007 Sievenpiper et al. ..... 343/909
7,283,085 B2 * 10/2007 Lee et al. ..... 342/6
7,420,524 B2 * 9/2008 Werner et al. ..... 343/909
2009/0303128 A1 * 12/2009 Robert et al. ..... 342/373

* cited by examiner

*Primary Examiner* — Douglas W Owens
*Assistant Examiner* — Chuc D Tran
(74) *Attorney, Agent, or Firm* — Matthew J. Evans; Daniel M. Barbieri

(57) ABSTRACT

The present invention is a Radio Frequency (RF) apparatus. The RF apparatus may include a layer of photoconductive material. The RF apparatus may further include a plurality of conductive patches which are disposed within the layer of photoconductive material. The RF apparatus may further include a generating layer. The generating layer may be operatively coupled to the layer of photoconductive material and may be configured for generating light. The generating layer may further be configured for providing the generated light to the layer of photoconductive material. The generated light may be configurable for being provided at a selectable intensity and in a selectable pattern for causing the layer of photoconductive material to be a dynamically controllable optical switch. The dynamically controllable optical switch may be configured for providing a connection between conductive patches included in the plurality of conductive patches.

9 Claims, 2 Drawing Sheets

RECONFIGURABLE RADIO FREQUENCY (RF) SURFACE WITH OPTICAL BIAS FOR RF ANTENNA AND RF CIRCUIT APPLICATIONS

FIELD OF THE INVENTION

The present invention relates to the field of Radio Frequency (RF) devices and particularly to a system and method for providing a reconfigurable RF surface with optical bias for RF antenna and RF circuit applications.

BACKGROUND OF THE INVENTION

A number of current RF devices, such as grid antennas or fragmented/pixilated antennas, may include Microelectromechanical systems (MEMS) switches. High resolution grid antennas may typically require a large number of MEMS switches, which may make them cost ineffective. Also, due to physical size limitations presented by the MEMS switches and the grid, the upper frequency bound/operating bandwidth of current grid antennas may be limited. Further, current grid antennas may require the implementation of complex equipment, such as Direct Current (DC) feed networks.

Thus, it would be desirable to provide a system/method for providing an RF device (ex.—antenna) which obviates the problems associated with current RF devices (ex.—antennas).

SUMMARY OF THE INVENTION

Accordingly, an embodiment of the present invention is directed to an apparatus, including: a layer of photoconductive material; a plurality of conductive patches, the plurality of conductive patches disposed at least partially within the layer of photoconductive material; and a generating layer, the generating layer operatively coupled to the layer of photoconductive material, the generating layer configured for generating light, the generating layer further configured for providing the generated light to the layer of photoconductive material, wherein the generated light is configurable for being provided at a selectable intensity and in a selectable pattern for causing the layer of photoconductive material to be a dynamically controllable optical switch, the dynamically controllable optical switch being configured for providing a connection between conductive patches included in the plurality of conductive patches.

An additional embodiment of the present invention is directed to a method including the steps of: providing a photoconductive layer for a Radio Frequency (RF) antenna; disposing a plurality of conductive pixels at least partially within the photoconductive layer of the RF antenna; generating light in a generating layer of the RF antenna; generating an antenna mask in the generating layer of the RF antenna; and projecting a light image onto the photoconductive layer of the RF antenna, the projected light image being derived from the generated light and the generated antenna mask, wherein the projected light image is configurable for being projected at a selectable intensity and in a selectable pattern for causing the photoconductive layer to be a dynamically controllable optical switch, the dynamically controllable optical switch being configured for biasing connectivity between a first conductive pixel included in the plurality of conductive pixels and a second conductive pixel included in the plurality of conductive pixels.

A further embodiment of the present invention is directed to a Planar Radio Frequency (RF) Programmable Grid Antenna, including: a photoconductive layer; a plurality of conductive metallic squares, the plurality of conductive metallic squares being disposed at least partially within the photoconductive layer; a generating layer, the generating layer being operatively coupled to the photoconductive layer, the generating layer configured for generating light and generating an antenna mask, the generating layer further configured for projecting a light pattern onto the photoconductive layer, the projected light pattern being derived from the generated light and the generated antenna mask; an optically transparent Printed Circuit Board (PCB) material layer, the optically transparent PCB material layer being disposed between the layer of photoconductive material and the generating layer; and an optically transparent conductive ground layer, the optically transparent conductive ground layer being disposed between the optically transparent PCB material layer and the generating layer, wherein the light pattern is selectable and is configurable for being provided at a selectable intensity for causing the photoconductive layer to be a dynamically controllable optical switch, the dynamically controllable optical switch being configured for biasing connectivity between adjacent metallic squares included in the plurality of metallic squares.

A still further embodiment of the present invention is directed to a Reconfigurable Radio Frequency (RF) surface with optical bias, including: a layer of photoconductive material; and a plurality of conductive patches, the plurality of conductive patches disposed at least partially within the layer of photoconductive material, wherein the layer of photoconductive material is configured for receiving light at a selectable intensity and in a selectable pattern for causing the layer of photoconductive material to be a dynamically controllable optical switch, the dynamically controllable optical switch being configured for biasing connectivity between conductive patches included in the plurality of conductive patches.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
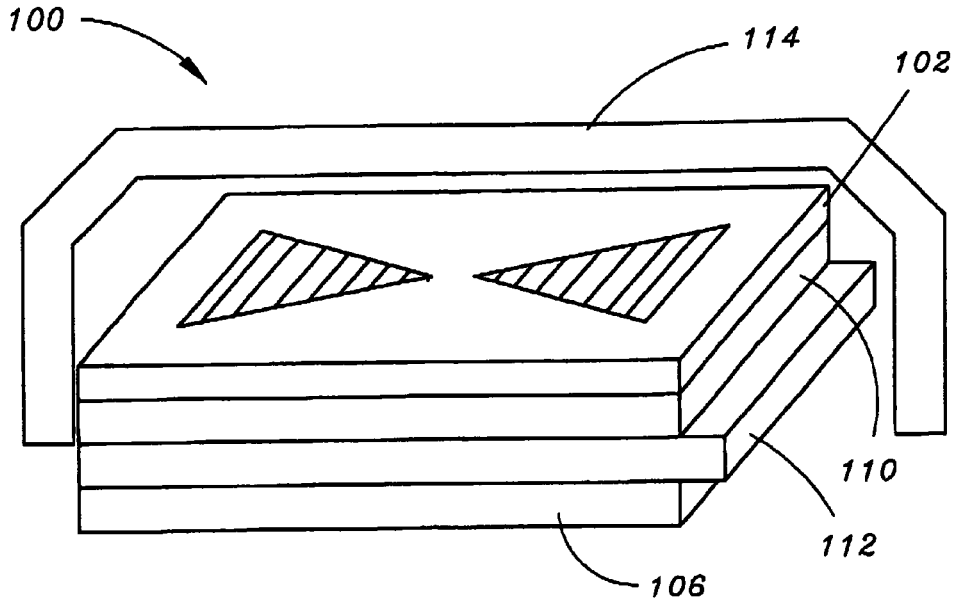
FIG. 1 is a view of an apparatus (ex.—an RF Programmable Grid Antenna) which includes an optically reconfigurable surface/aperture in accordance with an exemplary embodiment of the present invention.
Figure 2:
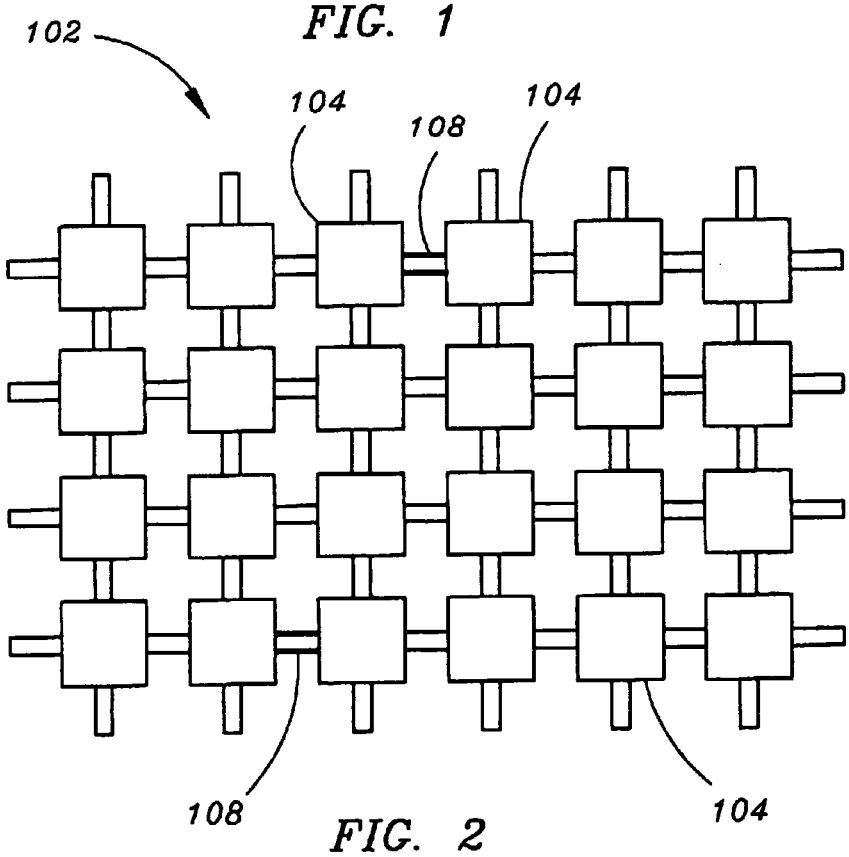
FIG. 2 is a view of a photoconductive layer, such as may be implemented by the apparatus of FIG. 1, in accordance with an exemplary embodiment of the present invention.

Referring generally to FIGS. 1 and 2, an apparatus in accordance with an exemplary embodiment of the present invention is shown. For example, the apparatus 100 may be/may include/may be implemented with/may provide a Radio Frequency (RF) device, an RF surface, an antenna (ex.—a fragmented/pixilated antenna, a planar antenna, an RF antenna, an RF Programmable Grid Antenna (RF PGA), a Planar RF Programmable Grid Antenna, an optically programmable grid antenna), an RF circuit, a filter, a variable transmission line, an RF system (which may include an RF Programmable Circuit Grid, component blocks, tunable filters and power dividers), a Planar RF Programmable Grid Antenna, a Planar RF Programmable Circuit Grid, a Conformal "Smart Skin" RF Programmable Grid Antenna, a Software-Defined Radio (SDR) antenna, a Joint Tactical Radio System (JTRS), an Instantaneous Scene Dynamic Range (ISDR) system, a Dual mode radar/communication system, a multi-function avionics system (for reducing aircraft antenna count), an RF Field Programmable Gate Array (RF FPGA), a combination L-band CND traffic+Radar Unmanned Aerial Vehicle (UAV) antenna, or the like.

In a current embodiment of the present invention, the apparatus 100 may include a layer (or brick) of photoconductive material 102 (ex.—photoconductive layer, photoconductive surface, and/or reconfigurable layer). The apparatus 100 may further include a plurality of conductive patches/conductive pixels 104 (see FIG. 2). For example, the conductive patches 104 may be metallic squares (as shown in FIG. 2). Alternatively, the conductive patches 104 may be various other shapes for promoting a reduction in capacitance between unit cells. In an exemplary embodiment of the present invention, the plurality of conductive patches 104 are disposed at least partially within the layer of photoconductive material 102. For instance, the photoconductive layer 102 may be impregnated with the conductive pixels 104 to form a reconfigurable surface (ex.—a reconfigurable RF surface). In further embodiments, the plurality of conductive patches/pixels 104 may be configured as a generally rectangular-shaped grid of metallic squares (as shown in FIG. 2). In embodiments in which the apparatus 100 is an RF antenna, the grid of conductive pixels 104 (ex.—metallic squares) may form a pixilated aperture for the RF antenna 100.

In exemplary embodiments of the present invention, the apparatus 100 may include a generating layer 106. Further, the generating layer 106 may be configured for generating light. For example, the generating layer 106 may implement/include one or more of the following: a Liquid Crystal Display (LCD); an Organic Light-Emitting Diode (OLED); a Laser; a Digital Light Projector (DLP), and/or a Light-emitting Diode (LED) for generating the light. Still further, the generating layer 106 is operatively coupled to the photoconductive layer 102 and is configured for providing/transmitting the generated light to the layer of photoconductive material 102. For instance, the generated light may be provided to the photoconductive layer 102 by projecting the generated light onto a surface of the photoconductive layer 102 (ex.—onto the pixilated aperture of the antenna). Alternatively, the generated light may be provided to the photoconductive layer 102 via a feed network.

In current embodiments of the present invention, the generated light may be provided/projected from the generating layer 106 to the photoconductive layer 102 at a selectable/selected intensity, such as a user-selected intensity. Further, the generated light may be provided/projected from the generating layer 106 to the photoconductive layer 102 as a light image or light pattern. Still further, the light image or light pattern may be a selectable/selected light pattern. For instance, if the apparatus 100 is an RF antenna (such as an RF Programmable Grid Antenna as shown in FIG. 1), the generating layer 106 may be configured for generating an antenna mask. Further, the light pattern/image projected onto the photoconductive layer 102 from the generating layer 106 may be based upon/derived from/dictated by the generated antenna mask (and the generated light).

In exemplary embodiments, providing the light to the photoconductive layer 102 may cause the photoconductive layer 102 to act as/become a dynamically controllable optical switch which may be configured for biasing connectivity/providing an active connection(s) 108 between/selectively connecting one or more pairs of adjacent conductive patches included in the plurality of conductive patches 104. (as shown in FIG. 2). In embodiments in which the apparatus 100 is an RF antenna, one conductive patch included in a pair of the one or more pairs of adjacent conductive patches may be a source patch for the RF antenna 100. In further embodiments, the dynamically controllable optical switch/photoconductive layer 102 may be a RF photoconductive switch.

In current embodiments of the present invention, the dynamically controllable optical switch/photoconductive layer 102 may be configured for being controlled by the light/light image/light pattern which is projected onto/provided to the photoconductive layer 102. For instance, the optical switch 102 may be placed into an "on" state and an "off" state (with respect to one or more pairs of adjacent conductive pixels included in the plurality of conductive pixels 104) based on the projected light/light image/light pattern which is projected onto/provided to the photoconductive layer 102. For example, the light image/light pattern may be dynamically selected/provided to the photoconductive layer 102 for causing the dynamically controllable optical switch 102 to be in an "on" state with respect to a pair of conductive pixels (ex.—a pair of adjacent conductive pixels) included in the plurality of conductive pixels 104, thereby causing the switch 102 to form an active connection 108 between the pair of conductive pixels. Further, the light image/light pattern may be dynamically selected/provided to the photoconductive layer 102 for causing the dynamically controllable optical switch 102 to be in an "off" state with respect to a pair of conductive pixels (ex.—a pair of adjacent conductive pixels) included in the plurality of conductive pixels 104, thereby causing the switch 102 to not form an active connection 108 or to disconnect an active connection 108 between the pair of conductive pixels.

In further embodiments, unlike MEMS switches, the dynamically controllable optical switch/photoconductive layer 102 of the present invention may be configured for being placed into a "partial on" state with respect to a pair of conductive pixels included in the plurality of conductive pixels 104 based on the projected light/light image/light pattern which is projected onto/provided to the photoconductive layer 102. For instance, as discussed above, the light/light pattern may be provided to the photoconductive layer 102 at varying, selectable degrees of intensity. Further, by providing the light/light pattern to the photoconductive layer 102 at varying, selectable degrees of intensity, the dynamically controllable optical switch 102 may form a partially active connection between the pair of conductive pixels 104 (ex.—the switch 102 may be partially "on" to several degrees with respect to the pair of conductive pixels) based upon the intensity level of the provided light/light pattern. In this manner, the light/light image/light pattern projected onto/provided to the photoconductive layer 102 controls the optical switch 102 by providing an indication to the switch 102 as to which pixels 104 are to be connected/disconnected/partially connected. Further, by controlling the light intensity and light pattern/image which is projected onto the photoconductive surface 102 as described above, the present invention provides an optical switch 102 which may be precisely and dynamically controlled for presenting any device/apparatus (ex.—planar antenna) desired.

In embodiments in which the apparatus 100 is a RF Programmable Grid Antenna/Planar RF Programmable Grid Antenna (as shown in FIG. 1), the apparatus/RF Programmable Grid Antenna 100 further includes an optically transparent Printed Circuit Board (PCB) material layer 110. The PCB material layer 110 may be disposed between the photoconductive layer 102 and the generating layer 106. In additional embodiments, the apparatus/RF Programmable Grid Antenna 100 may further include an optically transparent conductive ground layer 112. The optically transparent conductive ground layer 112 may be disposed between the optically transparent PCB material layer 110 and the generating layer 106. In further embodiments, the apparatus/RF Programmable Grid Antenna 100 may include a radome 114, such as an opaque radome. In exemplary embodiments, the mask generated by the generating layer 106 may be isolated from RF interference.

The apparatus 100, due to its implementation of the optical switch 102 described above, may provide a broader range of frequency coverage than devices which implement MEMS switches. This may be due to the fact that the optical switch 102 of the present invention is not restricted by the physical device size limitations facing devices which implement MEMS switches. Therefore, switching space dimensions do not restrict the ability of the photoconductive layer/reconfigurable surface/optical switch 102 of the present invention to go higher in frequency than MEMS switches. For example, in embodiments in which the apparatus 100 is a RF Programmable Grid Antenna/Planar RF Programmable Grid Antenna (as shown in FIG. 1), the Planar RF Programmable Grid Antenna 100 may be configured for providing broad band frequency coverage ranging from one Gigahertz to fifty Gigahertz (1-50 GHz).

Figure 3:
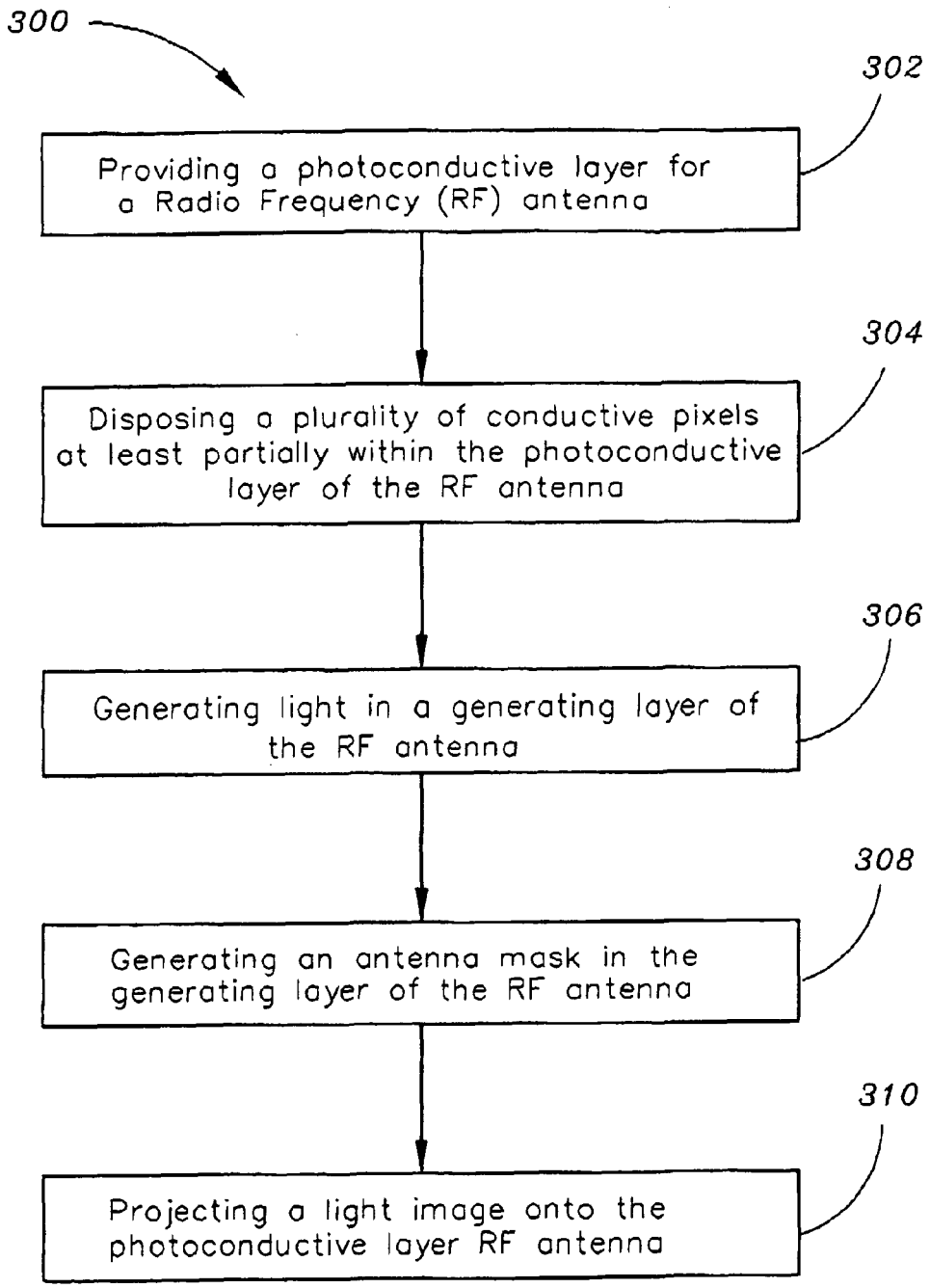
FIG. 3 is a flowchart illustrating a method for providing an optically reconfigurable RF device in accordance with an exemplary embodiment of the present invention.

Referring to FIG. 3, a flow chart illustrating a method in accordance with an exemplary embodiment of the present invention is shown. In a current embodiment of the present invention, the method 300 may include providing a photoconductive layer for a Radio Frequency (RF) antenna 302. The method 300 may further include disposing a plurality of conductive pixels at least partially within the photoconductive layer of the RF antenna 304. The method 300 may further include generating light in a generating layer of the RF antenna 306. The method 300 may further include generating an antenna mask in the generating layer of the RF antenna 308. The method 300 may further include projecting a light image onto the photoconductive layer of the RF antenna 310. In exemplary embodiments, the projected light image/light pattern may be derived from the generated light and the generated antenna mask. In further embodiments, the projected light image/light pattern may be configurable for being projected at a selectable intensity and in a selectable pattern for causing the photoconductive layer to be a dynamically controllable optical switch, the dynamically controllable optical switch being configured for biasing connectivity between a first conductive pixel included in the plurality of conductive pixels and a second conductive pixel included in the plurality of conductive pixels.

As described above, the photoconductive layer 102 (ex.—the brick of photoconductive material) of the present invention provides an optical switch 102, which, when implemented in RF devices/antennas, may promote cost efficiency. For example, rather than using multiple MEMS switches in an RF device/antenna (which can be costly and space inefficient due to the physical size limitations faced by the MEMS switches), the optical switch 102 of the present invention may be implemented. Further, the present invention's combination of providing the photoconductive layer 102 impregnated with the high conductivity, conductive pixels 104 for providing the optical switch 102 may promote reduced overall loss for the photoconductive surface (ex.—the photoconductive layer 102 and the conductive pixels 104) compared to current switching solutions when implemented within an RF device/antenna. Still further, the optical switch 102 of the present invention may promote improved pixel resolution over MEMS switches, since the optical switch 102 of the present invention does not have the cost limitations and physical device size limitations associated with the MEMS switches. For example, metallic squares implemented as conductive pixels 104 in the present invention may have diameters ranging from 0.1 nanometer to 1 centimeter. Additionally, the present invention may promote ease of implementation in that it may obviate the need for placing multiple, individual switch components (ex.—MEMS switches).

Further, the above-described light projection technology and masking technology of the present invention may provide a dynamic feed network. Additionally, the above-described invention may provide a dynamic optical network which may obviate having to use the complex, static Direct Current (DC) feed networks which are currently implemented in RF devices/antennas. Still further, the optical switch 102 of the present invention may be implemented in devices having larger aperture sizes than can be attained in devices which implement MEMS switches, and may do so with no additional complexity factor with control. Additionally, the present invention may allow for reconfigurable, re-tunable and re-usable antennas, RF circuit applications, RF systems, or the like. In further embodiments, the present invention may allow for development of an RF Programmable Circuit Grid which may provide ad-hoc connections between active component blocks, tunable filters and power dividers, which may thereby form completely agile RF Systems. In additional embodiments, the optical switch 102 of the present invention may have a longer switching lifetime than MEMS switches, since there is no switch cycle limitation on optical switches. In embodiments in which the apparatus 100 is a programmable grid antenna (such as shown in FIG. 1), the present invention allows for an optically programmable grid antenna 100 which provides control of: antenna orientation, bandwidth, directivity (or gain), radiation pattern, or type and number of elements.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is to be noted that the foregoing described embodiments according to the present invention may be conveniently implemented using conventional general purpose digital computers programmed according to the teachings of the present specification, as will be apparent to those skilled in the computer art. Appropriate software coding may readily be prepared by skilled programmers based on the teachings of the present disclosure, as will be apparent to those skilled in the software art.

It is to be understood that the present invention may be conveniently implemented in forms of a software package. Such a software package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method, comprising:

providing a photoconductive layer for a Radio Frequency (RF) antenna;

disposing a plurality of conductive pixels at least partially within the photoconductive layer of the RF antenna;

generating light in a generating layer of the RF antenna;

generating an antenna mask in the generating layer of the RF antenna; and projecting a light image onto the photoconductive layer of the RF antenna, the projected light image being derived from the generated light and the generated antenna mask, wherein the projected light image is configurable for being projected at a selectable intensity and in a selectable pattern for causing the photoconductive layer to be a dynamically controllable optical switch, the dynamically controllable optical switch being configured for biasing connectivity between a first conductive pixel included in the plurality of conductive pixels and a second conductive pixel included in the plurality of conductive pixels.

2. A method as claimed in claim 1, wherein the plurality of conductive pixels is a generally rectangular-shaped grid of metallic squares.

3. A method as claimed in claim 2, wherein the grid of metallic squares forms a pixilated aperture for the RF antenna.

4. A method as claimed in claim 1, wherein one of the first conductive pixel and the second conductive pixel is a source patch of the RF antenna.

5. A method as claimed in claim 1, wherein the dynamically controllable optical switch is configured for being placed into an on state and an off state based on the projected light image.

6. A method as claimed in claim 5, wherein the dynamically controllable optical switch is configured for being placed into a partial on state based on the projected light image.

7. A Planar Radio Frequency (RF) Programmable Grid Antenna, comprising:

a photoconductive layer;

a plurality of conductive metallic squares, the plurality of conductive metallic squares being disposed at least partially within the photoconductive layer;

a generating layer, the generating layer being operatively coupled to the photoconductive layer, the generating layer configured for generating light and generating an antenna mask, the generating layer further configured for projecting a light pattern onto the photoconductive layer, the projected light pattern being derived from the generated light and the generated antenna mask;

an optically transparent Printed Circuit Board (PCB) material layer, the optically transparent PCB material layer being disposed between the layer of photoconductive material and the generating layer; and an optically transparent conductive ground layer, the optically transparent conductive ground layer being disposed between the optically transparent PCB material layer and the generating layer, wherein the light pattern is selectable and is configurable for being provided at a selectable intensity for causing the photoconductive layer to be a dynamically controllable optical switch, the dynamically controllable optical switch being configured for biasing connectivity between adjacent metallic squares included in the plurality of metallic squares.

8. A Planar Radio Frequency (RF) Programmable Grid Antenna as claimed in claim 7, wherein the antenna is configured for providing broad band frequency coverage at a value included in the range of 1 Gigahertz (GHz) through 50 GHz.

9. A Planar Radio Frequency (RF) Programmable Grid Antenna as claimed in claim 8, wherein each metallic square included in the plurality of metallic squares has a diameter value included in the range of 0.1 nanometer through 1 centimeter.

* * * * *